US006978791B2

(12) United States Patent
Lee

(10) Patent No.: US 6,978,791 B2
(45) Date of Patent: Dec. 27, 2005

(54) STRUCTURE OF A COMPACT CASE

(76) Inventor: Jong Nam Lee, 2601 Hyundai Pantheon Apt., 21-2 Sunae-Dong, Bundang-Gu, Seongnam-Si, Kyunggi-Do (KR) 463-825

( * ) Notice: Subject to any disclaimer, the term of this patent is extended or adjusted under 35 U.S.C. 154(b) by 352 days.

(21) Appl. No.: 10/642,241

(22) Filed: Aug. 18, 2003

(65) Prior Publication Data

US 2004/0154634 A1 Aug. 12, 2004

(30) Foreign Application Priority Data

Feb. 10, 2003 (KR) ..... 20-2003-0003795 U

(51) Int. Cl.[7] ..... A45D 33/00; A45D 33/22
(52) U.S. Cl. ..... 132/293; 132/295
(58) Field of Search ..... 132/293–295; 220/334, 524–528, 422, 263; 206/581, 823

(56) References Cited

U.S. PATENT DOCUMENTS 2,737,189 A * 3/1956 Morningstar et al. ..... 132/305
4,454,889 A * 6/1984 Contreras, Sr. ..... 132/301
5,908,037 A * 6/1999 Pierson ..... 132/293
5,909,738 A * 6/1999 Quennessen ..... 132/293
6,129,088 A * 10/2000 Favre ..... 132/293

* cited by examiner

*Primary Examiner*—John J. Wilson
*Assistant Examiner*—Robyn Doan

(57) ABSTRACT

A new style of a compact case for cosmetics and a powder puff is provided with a smooth outer surface without protruding portions. Due to the soft and elastic front structure connected to the latching device, it is convenient and easy to open and close simply by pressing the front surface of the circumference frame. A structure of a compact case comprises the following components: a cylindrically-shaped lower case (40) integrally formed with a recessed axle-bearing portion (41) for mounting a hinge axle, a cylindrically-shaped cover (10) integrally formed with a hook at the front portion and a projected hinge (11) at the rear portion for rotatably mounting to the recessed axle-bearing portion (41) through the hinge axle, a circumferential, cylindrically-shaped external frame (30) with a soft, elastic front portion for releasing the hook by pressing the front external surface, the circumferential external frame (30) disposed between the lower case (40) and the cover (10), a latching slot (31) located on an arcuated segment **(31*a*) of the circumferential external frame (30) for latching the hook, and an inner liner (20) formed with a cylindrically-shaped lateral skirt and a disk-shaped flange (21) at the top surface and inserted inside of the circumferential external frame (30)**.

6 Claims, 2 Drawing Sheets

STRUCTURE OF A COMPACT CASE

BACKGROUND OF THE INVENTION

1. Field of the Invention

The present invention relates to a structure of a compact case comprising a cover integrally formed with a latch at the front portion and a built-in hinge at the opposite side, a circumferential outer frame formed with a latching slot and a hinge mount at the opposite side, a guide liner for filling with cosmetic materials, and a bottom base integrally formed with a hinge at the rear side. More particularly, the present compact case is provided with smooth external features without any protruding portions, and an elastic outer frame that easily may be opened and closed simply by pressing the front of the outer circumferential frame.

2. Related Prior Art

A conventional compact case is generally configured with a compartment of the main body for filling with cosmetic materials and a powder puff, and a cover equipped with a mirror on the inside as well as a hinge attaching the rear portion of the cover to the main body for rotatably supporting the case.

A latching device formed in the front portion of the main body and the cover is essential for latching the compact case. There are various structures of latching devices introduced and currently used. However, most conventional latching devices and hinges protrude from the compact cases.

As shown in FIG. 1, the structure of a conventional compact case usually consists of a lower main body (2) for filling with cosmetic materials, a cover (4) being operable for opening and closing, with a hinge attached to the main body (2) and the cover at its rear end. In addition, an inner liner (6) is provided inside of the main body (2) for filling with cosmetic materials and a powder puff (5).

Most conventional compact cases have a dent **(2*a*) and hook (4*a*) structure for locking and opening the cover (4). Usually, the dent (2*a*) and hook (4*a*) are disposed at the edge of the main body (2) and cover, (4)** respectively, for engaging each other.

Such a structure must be provided with an additional opening device such as a push button to separate the dent **(2*a*) and hook (4*a*). Otherwise, a user has to push the cover (4) upward while grasping the main body (2), or place her fingertip between the main body (2) and the cover (4)** in order to open the case.

However, it is not convenient to open the cover (4) by pushing and grasping the case or by placing a finger between the main body (2) and the cover (4), as is necessary in dent **(2*a*) and hook (4*a*)** structures. Although a push button device is easy to operate, it presents many problems in assembly and durability.

Further, the dent **(2*a*) and hook (4*a*)** may inadvertently become separated by external impact, causing the case to open and cosmetics to spill from the case into the user's handbag.

Furthermore, protruding parts, such as a hinge system and latching device of the compact case, may cause damage to the handbag or to expensive jewelry in the handbag.

SUMMARY OF THE INVENTION

To achieve the aforementioned objectives, the new style of compact case of the present invention is developed. The structure of this compact case enables easy opening and closing by the simple operation of pressing the front outer surface of the circumferential frame.

An objective of this invention is to provide a structure of a compact case for filling with cosmetic materials and a powder puff, the compact case comprising the following components: a cylindrically-shaped lower case (40) integrally formed with a recessed axle-bearing portion (41) for mounting a hinge axle; a cylindrically-shaped cover (10) integrally with formed a hook at the front portion and a projected hinge (11) at the rear portion for rotatably mounting to the recessed axle-bearing portion (41) through the hinge axle; a circumferential, cylindrically-shaped external frame (30) with a soft, elastic front portion for releasing the hook when the front external surface is pressed; a circumferential external frame (30) disposed between the lower case (40) and the cover (10); a latching slot (31) located on an arcuated segment (34) of the circumferential external frame (30) for latching the hook; and an inner liner (20), formed with a cylindrically-shaped lateral skirt and a disk-shaped flange, (21) at the top surface and inserted inside of the circumferential external frame (30).

Another objective of the present invention is to provide a structure of a compact case having a circumferential external frame (30) formed with a flat front positioned inwardly on the arcuated segment **(31*a*) and a rectangular-shaped cutout at the rear portion for matching with the recessed axle-bearing portion (41) of the lower case (40)**.

Another objective of the present invention is to provide a disk-shaped flange (21) at the top surface of the inner liner (20) formed with a flat front **(21*a*) and a rectangular-shaped cutout at the rear portion for matching with the rectangular-shaped cutout of the circumferential external frame (30). The flat cutout (21*a*) of the inner liner (20) and the flat front (31*a*) of the circumferential external frame (30) provide a gap or overlap for operating the latching slot (31). The cylindrically-shaped lateral skirt of the inner liner (20) is disposed along the inside wall of the circumferential external frame (30) to form a compartment with the bottom portion of the lower case (40), and the edge of the disk-shaped flange (21) of the inner liner (20) is internally sealed along the rim of the circumferential external frame (30)**.

Another objective of the present invention is to provide a compact case with a smooth, circular exterior surface without any protruding portions and a circumferential external frame (30), lower case (40) and cover in which the latching device and projected hinge (11) are mounted inside of the recessed axle-bearing portion (41).

DETAILED DESCRIPTION OF THE PREFERRED EMBODIMENT

Figure 1:
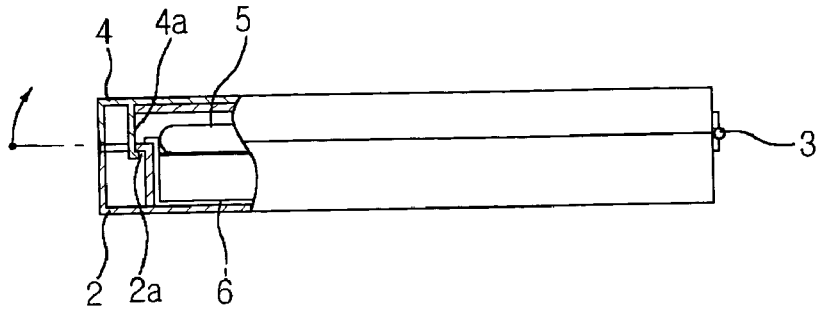
Fig. 1(Prior Art)
FIG. 1 is a cross-sectional view of a conventional compact case.

In order to achieve the aforementioned objectives, a new style of a compact case of the present invention has been developed. The structure of the compact case is configured as follows: a cylindrically-shaped lower case (40) integrally formed with a recessed axle-bearing portion (41) for mounting a hinge axle from underneath the lower case (40). The circumferential external frame (30) is also cylindrically shaped, with a soft, elastic front portion for releasing the latch by pressing the front external surface. A latching slot (31) is located on top of an arcuated segment (34) of the circumferential external frame (30) for latching. An inner liner (20) having a cylindrically shaped lateral skirt (23) and a disk-shaped flange (21) at the top surface is inserted inside of the circumferential external frame (30). Thus, the cylindrically shaped lateral skirt (23) is disposed as an inner wall along the inside of the circumferential external frame (30) to form a compartment with the bottom portion of the lower case (40). The rim of the circumferential external frame (30) is internally mated along the edge of the disk-shaped flange (21) for sealing. At the front of the inner liner (20), a flat cutout **(21*a*) is formed to mate with the flat front (31*a*) of the circumferential external frame (30). At the rear portion of the circumferential external frame (30) and the inner liner (20), the rectangular-shaped cutouts (32, 22) are formed to match with the recessed axle-bearing portion (41) of the lower case (40). A cover (10) is integrally formed with a hook (12) at the front portion for engaging the latching slot (31), as well as a projected hinge (11)** at the rear portion for rotatably mounting.

It is preferable to have a gap or overlap between the flat cutout **(21*a*) of the inner liner (20) and the flat front (31*a*) of the circumferential external frame (30) for operating the latching slot (31). Because the projected hinge (11) is installed inside of the recessed axle-bearing portion (41) of the lower case (40), the external feature of this compact case, including the cover (10) and the circumferential external frame (30)**, is a smooth, circular surface without any protruding portions.

Hereinafter, an implementing example is described in detail, along with accompanying drawings.

This compact case is designed to be easily operable for opening and closing by simply pressing the soft, elastic front portion of the circumferential frame. Due to the connection between the latching slot and the front portion of circumferential frame, it is easy to release the engagement of the latching slot and the hook on the cover. Further, the external feature of the present compact case is designed to create a smooth, circular surface without any protruding portions by adopting the built-in hinge and latching system of the recessed axle-bearing portion. The philosophy of the present design will not be limited or restricted to this invention, and, of course, can be modified and performed in various ways by skilled persons.

Figure 3:
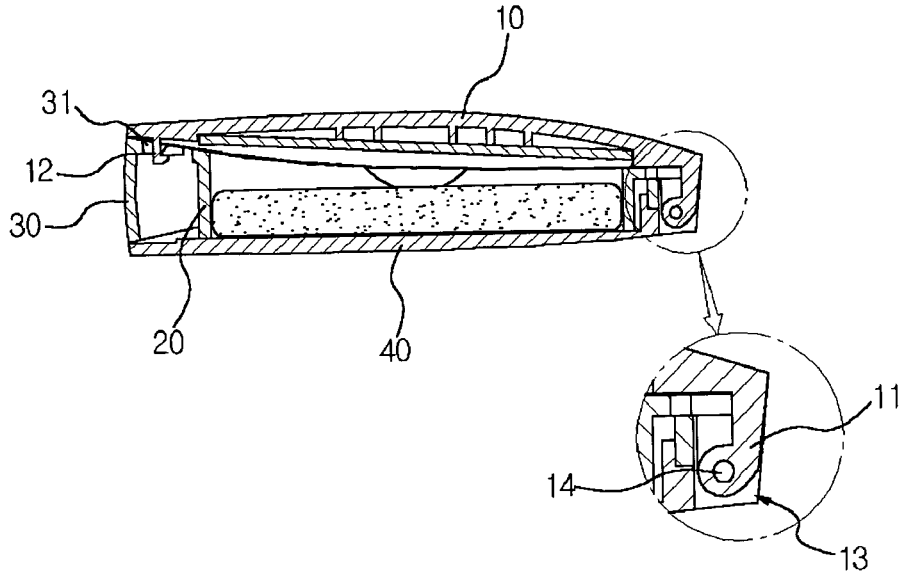
FIG. 3 is a cross-sectional view of the compact case according to the present invention.
Figure 2:
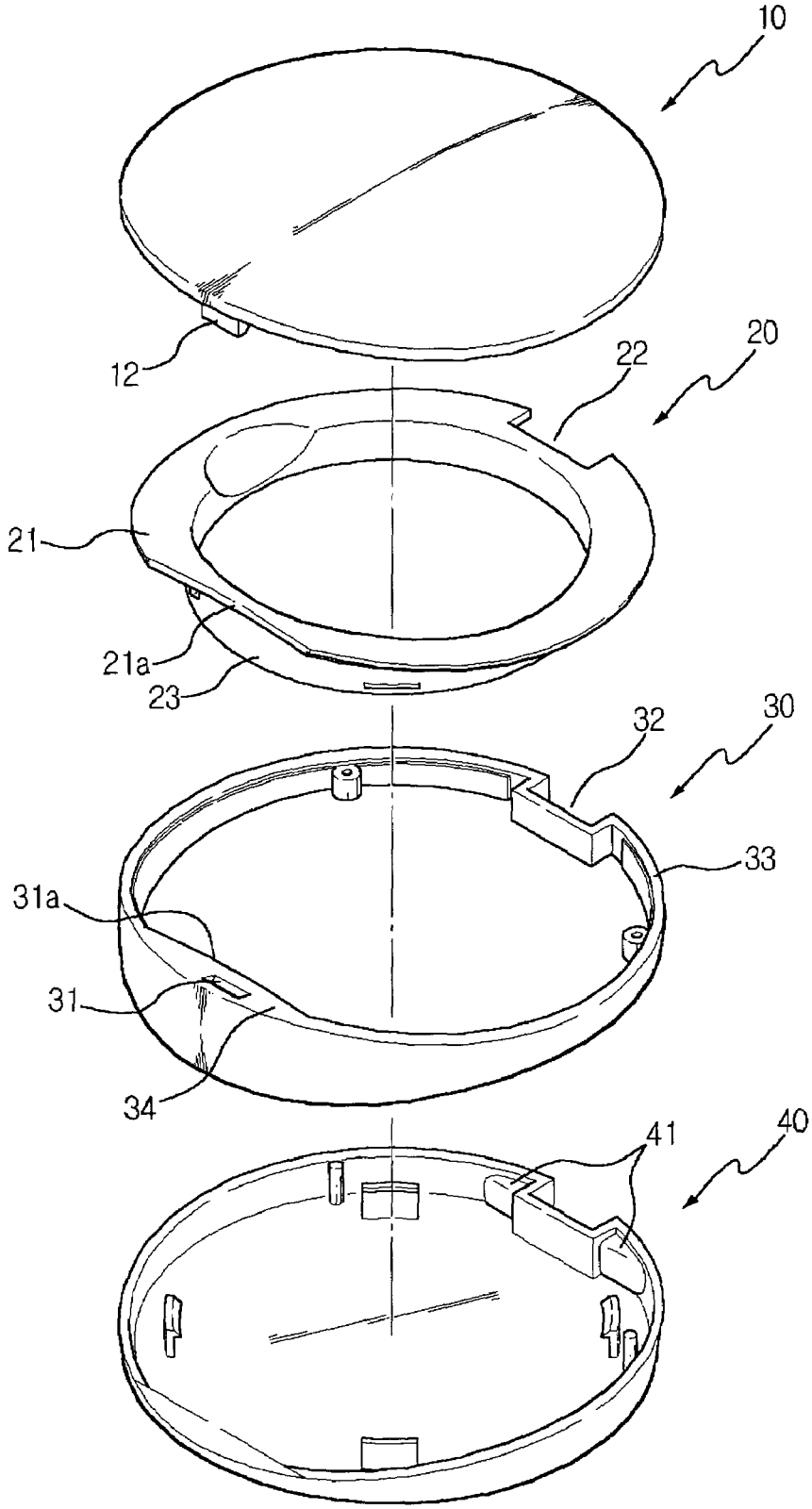
FIG. 2 is an exploded perspective drawing of the compact case according to the present invention.

Referring to FIGS. 2 and 3, the structure of the present compact case is mainly divided into the following four sections: a circularly-shaped cover (10), a circularly-shaped lower base case (40), a circularly-shaped intermediate inner liner (20) provided with a compartment for cosmetic materials, and a circularly-shaped, elastic circumferential outer frame (30) disposed between the cover (10) and the lower case (40). The circularly-shaped cover (10) may have a smooth, convex external surface and a flat circular mirror attached on its inside surface. A hook (12) is integrally formed on the front portion of the cover (10), and a projected hinge (11) is integrally formed at the opposite side. A hinge axle (14) is inserted through the axis of the projected hinge (11) of the cover (10) and mounted into the recessed axle-bearing portion (41). A hinge assembly (13), comprising the projected hinge (11) extended from the cover (10), the hinge axle and the recessed axle-bearing portion (41), is rotatably combined.

The inner liner (20) is disposed inside of the circumferential external frame (30). The base of the lower case (40) and the inner liner (20) comprise a compartment of a specified volume that is to be filled with cosmetic materials. The inner liner (20) comprises a cylindrically shaped skirt (23) at the lateral portion and a disk-shaped flange (21) at the top portion. The cylindrically shaped lateral skirt (23) is located inside of the circumferential external frame (30) to provide a lower case (40) of a certain volume. The edge of the disk-shaped flange (21) is matched with the rim of the circumferential external frame (30) to seal the compartment. The inner liner (20) is also formed with a flat cutout **(21*a*) at the front portion to mate with the flat front (31*a*) of the circumferential external frame (30). A set of rectangular-shaped cutouts (22, 32) is formed at the rear of the circumferential external frame (30) and the inner liner (20) to mate with the recessed axle-bearing portion (41) of the lower case (40). A hook (12) is integrally formed on the front portion of the cover (10) for engaging to the latching slot (31) of the circumferential external frame (30). A projected hinge (11) is also integrally formed at the rear portion of the cover (10) for rotatably mounting to the recessed axle-bearing portion (41) of the lower case (40)**.

The front portion of the circumferential external frame (30) is made of a soft, elastic material for releasing the latch by pressing. An arcuated segment (34) for installing the latching slot (31) is provided on the top surface of the front portion of the circumferential external frame (30). The circumferential external frame (30) has a cylindrical band-shape with various widths being gradually reduced from front to back.

The flat front **(31*a*) formed at the circumferential external frame (30) is matched with the flat cutout (21*a*) formed at the front portion of the inner liner (20). The rectangular-shaped cutout (32) formed at the rear portion of the circumferential external frame (30) is matched with the rectangular-shaped cutout (22) formed at the inner liner (20) and the recessed axle-bearing portion (41) of the lower case (40). The soft, elastic front surface of the circumferential external frame (30) is internally connected to the latching slot (31). Therefore, when a user presses the front surface of the circumferential external frame (30), the latching slot (31) is shifted back to release the hook (12)**.

A certain clearance is provided for sliding back a releasing device between the flat cutout **(21*a*) of the inner liner (20) and the flat front (31*a*) portion of the circumferential external frame (30) for operating the latching slot (31). Thus, smooth operation is carried out when the user simply presses the outer front surface of the circumferential external frame (30)**.

Figure 4:
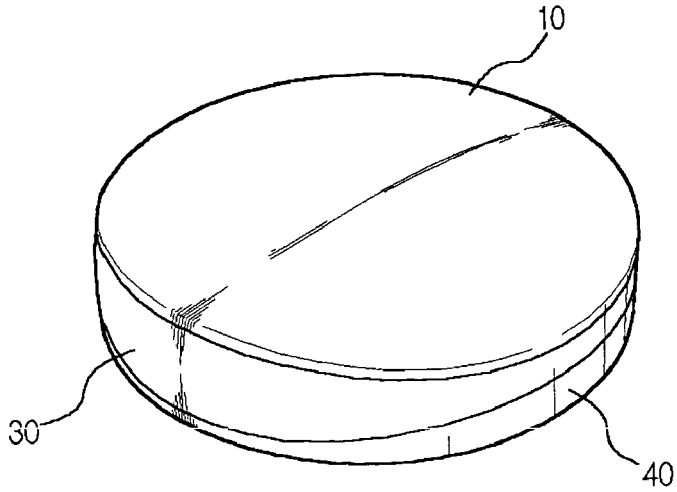
FIG. 4 is a schematic drawing of the compact case according to the present invention.

As shown in FIG. 4, due to the internal installment of the hinge and latching device, the external feature of this compact case, including the cover (10) and the circumferential external frame (30), is a smooth, circular surface without any protruding portions. This outer feature is aesthetically pleasing to the user. Furthermore, because there are no sharply projecting parts, the risk of damage to a user's belongings in her handbag during the storage or operating of the case, is greatly diminished.

As discussed above, the structure of the compact case of this invention has the following advantages: A user may easily open and close the case with a simple touch. When the user presses the front surface of the circumferential frame, the latching device easily releases the cover.

It is possible to avoid damage to a user's handbag and waste of its contents due to accidental spilling.

The smooth external features of present invention, as compared with a conventional compact case, reduce the potential for trouble.

While the present invention has been described in detail with its preferred embodiments, it should be understood that further modifications are possible. The present application is therefore intended to cover any variations, uses or adaptations of the invention following the general principles thereof, and includes such departures from the present disclosure as come within known or customary practice in the art to which this invention pertains within the limits of the appended claims.

What is claimed is:

1. A structure of a compact case for filling with cosmetic materials and a powder puff, the compact case comprising the following components:

a cylindrically shaped lower case (40) integrally formed with a recessed axle-bearing portion (41) for mounting a hinge axle, a cylindrically-shaped cover (10) integrally formed with a hook at the front portion and a projected hinge (11) at the rear portion for rotatably mounting to said recessed axle-bearing portion (41) through said hinge axle, a circumferential external frame (30) formed with a cylindrically-shaped soft, elastic front portion for releasing said hook by pressing the front external surface, said circumferential external frame (30) disposed between said lower case (40) and cover (10), a latching slot (31) located on an arcuated segment (31*a*) of the circumferential external frame (30) for latching said hook, and an inner liner (20) formed with a cylindrically shaped lateral skirt and a disk-shaped flange (21) at the top surface and inserted inside of said circumferential external frame (30).

2. A structure of a compact case as claimed in claim 1, wherein said circumferential external frame (30) is further formed with a flat front inwardly positioned on said arcuated segment (31*a*) and a rectangular-shaped cutout at the rear portion for matching with said recessed axle-bearing portion (41) of the lower case (40).

3. A structure of a compact case as claimed in claim 1, wherein said disk-shaped flange (21) at the top surface of said inner liner (20) is further formed with a flat front (21*a*), a rectangular-shaped cutout at the rear portion for matching with said rectangular-shaped cutout of said circumferential external frame (30).

4. A structure of a compact case as claimed in claim 3, wherein said flat cutout (21*a*) of the inner liner (20) and said flat front (31*a*) of the circumferential external frame (30) provide a gap or overlap for operating the latching slot (31).

5. A structure of a compact case as claimed in claim 1, wherein said cylindrically-shaped lateral skirt of said inner liner (20) is disposed along the inside of said circumferential external frame (30) to form a compartment with the bottom of said lower case (40), and the edge of said disk-shaped flange (21) of the inner liner (20) is internally sealed along the rim of the circumferential external frame (30).

6. A structure of a compact case as claimed in claim 1 further comprises a cover with a smooth, circular exterior surface without any protruding portions, the circumferential external frame (30) and the lower case (40) upon which said latching device and projected hinge (11) are mounted inside of said recessed axle-bearing portion (41).

* * * * *